United States Patent [19]

Gabriel

[11] 4,384,752

[45] May 24, 1983

[54] HOOK-UP WIRES WITH MAGNETIC CONNECTORS

[76] Inventor: Edwin Z. Gabriel, 91 Mt. Tabor Way, Ocean Grove, N.J. 07756

[21] Appl. No.: 222,177

[22] Filed: Jan. 2, 1981

[51] Int. Cl.[3] ..... H01R 9/02

[52] U.S. Cl. ..... 339/12 R; 434/224

[58] Field of Search ..... 339/12; 434/224, 301

[56] References Cited

U.S. PATENT DOCUMENTS 3,145,483 8/1964 Cruz ..... 434/224

*Primary Examiner*—Joseph H. McGlynn
*Assistant Examiner*—Timothy V. Eley

[57] ABSTRACT

For electronic experimental breadboards, connections can be made quickly, inexpensively using magnetic connectors. One way to accomplish this is by using hook-up wires with horseshoe- or U-shaped magnets at one or both of its ends. A U-shaped magnet can be inserted onto a cylindrical terminal post and also can be removed quickly with little effort. The magnet would hang on to a ferrous post by magnetic attraction. If the magnet should be of ceramic material and non-conductive, then the magnet would be coated with a conductive paint. To avoid magnets from sticking together, spacers are used, either by attaching plastic wafers or rings to the post or by providing grooves of the proper width in the post itself to receive the magnet. If spring terminals are used, instead of cylindrical posts, then the magnets are disc-shaped and placed on top of a terminal. A projected cylindrical portion at the bottom of each magnet drops into the terminal's central hole to keep the magnet in position centrally. A cavity is provided on top of each magnet to enable another such magnet to be placed centrally on top. A plastic ring is adhered, by cementing, to the top of each magnet to keep them apart and permit easier removal. Hence, a user has the choice either of inserting hook-up wire ends between coils of a spring terminal or of connecting one terminal to another using a disc-shaped magnet.

Two or more independent terminals, side by side, can be patched almost simultaneously by using a plastic sleeve to envelop and hold together two or more magnets. Hence, two U-shaped magnets, held together by a plastic sleeve, can be applied to two posts. They also can be removed from two posts almost simultaneously. The method of patching suggested here encourages creative experimenting on the part of the student and researcher.

6 Claims, 25 Drawing Figures

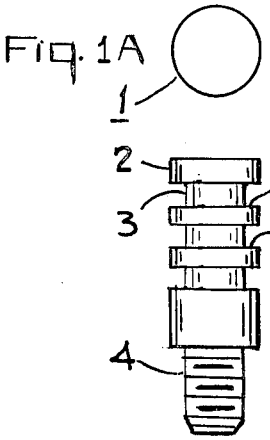
Fig. 1A
Fig. 1B
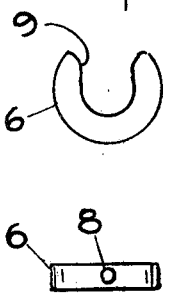
Fig. 2A
Fig. 2B
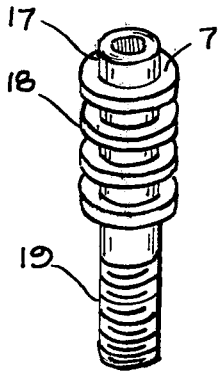
Fig. 5
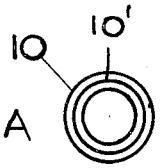
Fig. 3A
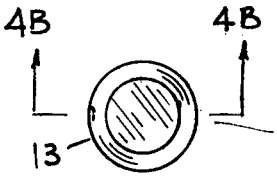
Fig. 4A
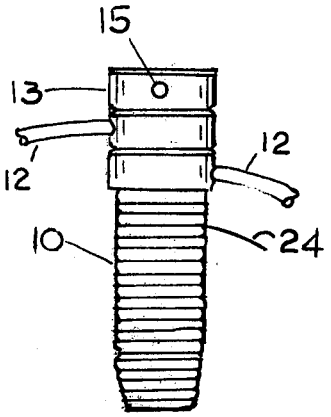
Fig. 6
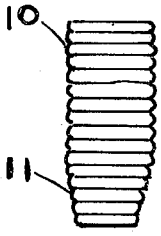
Fig. 3B
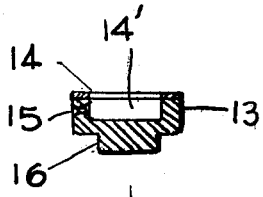
Fig. 4B
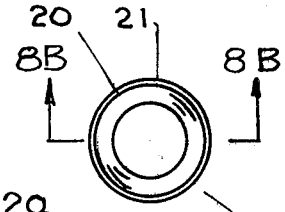
Fig. 8A
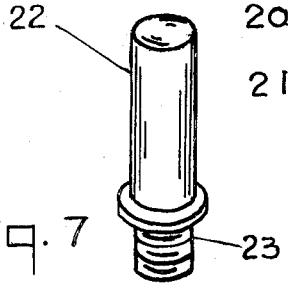
Fig. 7
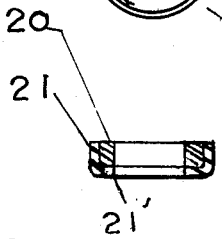
Fig. 8B

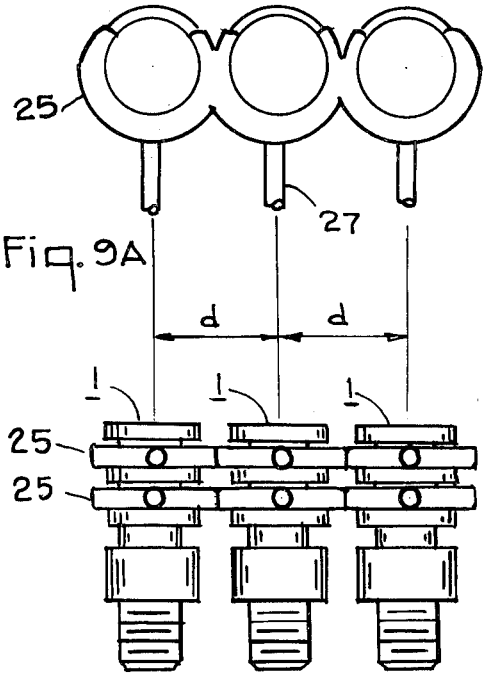
Fig. 9A
Fig. 9B
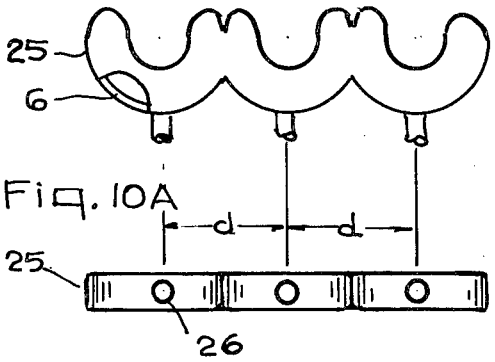
Fig. 10A
Fig. 10B
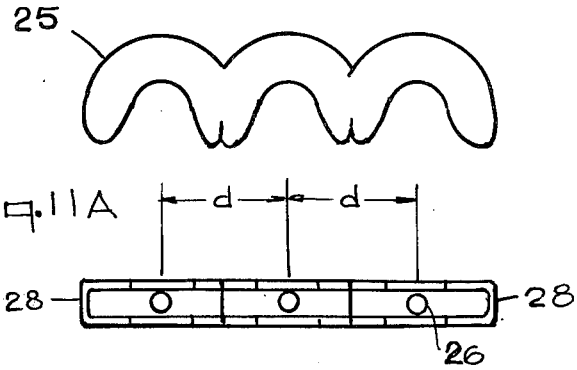
Fig. 11A
Fig. 11B
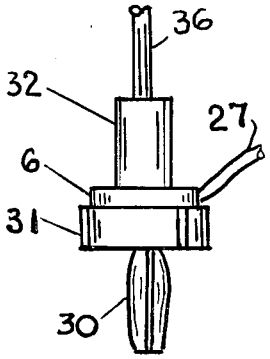
Fig. 12
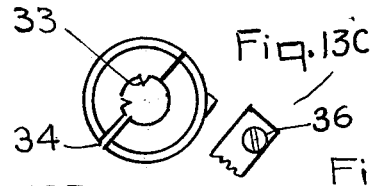
Fig. 13C
Fig. 13B
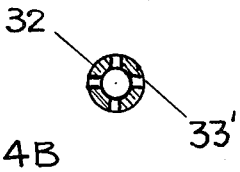
Fig. 14B
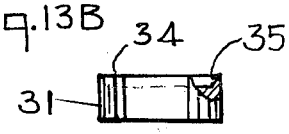
Fig. 13A
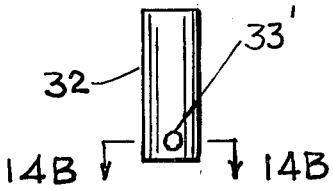
Fig. 14A

HOOK-UP WIRES WITH MAGNETIC CONNECTORS

BACKGROUND OF THE INVENTION

The present invention relates to patch cords and hook-up wires used for educational computers, electronic kits and laboratories for experimentation, solar energy kits and for radio, TV and computer testing. Alligator clips, banana plugs and just plain wires have been used to breadboard electrical circuits. Usually only a single alligator clip or banana plug can be attached to a test point or to a jack. On the other hand, several patch cords, equipped with horseshoe-shaped magnets, the alternate technique, can be quickly attached to a ferrous metal post and with less effort. They can be either stacked one upon the other or they can be applied to a notched terminal, one magnet per notch. Application and removal from the post can be done quickly and probably with less wear and tear than using a banana plug. In addition, the cost of a patch cord would be less using magnets than one using banana plugs. It should be noted, however, that alligator clips may also be used in combination with magnetic connectors. The proposed technique would not render alligator clips obsolete, neither is it the intention to render banana plugs obsolete. If the cylindrical surface above the banana plug were to have a ferrous metallic ring, then a U-shaped magnet could adhere to it for speeding up the trying out of experimental circuits by students.

SUMMARY OF THE INVENTION

This invention relates to an improvement in the state-of-the-art of hooking up circuits, with respect to the time consumed in implementing connections between points, of electronic components, in reliability of contact continuity and in reduction of cost of parts.

Several horseshoe- or disc-shaped magnets can be applied to a single terminal post for conducting electricity between two points of a breadboard. The horseshoe magnets are equally spaced apart on the post by means of non-ferrous rings fixed to the ferrous post. If ceramic permanent magnets are used, then the interior surface of the magnet may be coated with copper so that there would be good electrical conduction between the post and the magnets. The end of an insulated wire can be stripped and then soldered to the magnet. Instead of thick rings extending or projecting out from the post, the post could contain equally spaced magnets. By spacing the magnets apart from each other, each magnet can be either removed from or applied to the post more easily. Also time and wear and tear are saved.

Finally, the magnets themselves could be fitted with polished plastic on one surface, either on its upper or lower surface, thus somewhat performing the function of a spacer.

The magnets may be either horeshoe-shaped or disc-shaped. If disc-shaped, the top magnets would have to be removed first before a magnet placed lower can be removed from the post. Thus, a disc-shaped magnet may not be as convenient to use as a horseshoe-shaped magnet.

BRIEF DESCRIPTION OF THE DRAWINGS

For the purpose of illustrating the invention, the drawings show forms which are presently preferred. It is to be understood, however, that this invention is not necessarily limited to the precise arrangement, instrumentalities and field of utility as therein demonstrated.

FIG. 1A is a top/plan view of a post or terminal.

FIG. 1B is an elevation of the post or terminal.

FIG. 2A is a top view of a horseshoe- or U-shaped magnet.

FIG. 2B is an edge view of the magnet.

FIG. 3A is a top view coiled spring terminal.

FIG. 3B is an elevation of the spring terminal. Its lower end would enter a hole in a panel.

FIG. 4A is the top view of a circular magnet.

FIG. 4B is a section taken across the line 4B—4B.

FIG. 5 is an isometric view of a hollow post with equally-spaced wafers cemented to the post.

FIG. 6 is an assembly of FIGS. 3B and 4B to show how the circular magnets could stack up on one another on top of spring terminal shown in FIG. 3B.

FIG. 7 is an isometric view of a plain post terminal onto which ring magnets may be stacked up.

FIG. 8A is the top view of a ring-shaped magnet, plastic covered at its bottom and circumference.

FIG. 8B is a sectional view along line 8B—8B.

FIG. 9A is a top view of an assembly of three plastic covered magnets, mounted equally spaced, on posts and with the plastic covering sufficiently rigid to keep magnets equally spaced, even when removed from posts.

FIG. 9B is an elevation view of the above assembly.

FIG. 10A is a top view of just the plastic sleeve and the three horseshoe magnets in position.

FIG. 10B is a side view of the above assembly.

FIG. 11A is a top view of just the plastic sleeve.

FIG. 11B is a side front view showing the opening for insertion of the horseshoe-shaped magnets.

FIG. 12 shows an assembly of a standard banana plug with a split springy ferrous ring and a U-shaped magnet.

FIG. 13A is a side view of the split ring for attachment to the plastic sleeve of the banana plug.

FIG. 13B is a top view of the split ring.

FIG. 14A is a side view of the plastic sleeve modified with holes for holding split ring in position.

FIG. 14B is a sectional view taken along lines 14B—14B.

FIG. 13C is a partial side view of ring showing a set screw holding ring halves together.

DESCRIPTION OF PREFERRED EMBODIMENTS

The preferred embodiments have been designed mainly with the thought in mind of reducing time in making temporary connections between terminals of breadboard circuitry or for a school laboratory experiment.

In reference to the accompanying drawings, FIG. 1A illustrates a plan or top view of a terminal post 1 with annular indentations 3 equally spaced for acceptance of U-shaped magnets, FIG. 2A. The indentations 3 are shown in side view FIG. 1B. The magnets 6 are held apart by larger diameter cylinders 2. Surfaces 5 of post 1 may be copper-coated for improved electrical conduction. FIG. 2B of magnet shows hole 8 for insertion of a hook-up wire end. The wire end may be soldered into the hole if its interior is copper-coated. To make up a patch cord for making connections between two posts 1, an insulated wire of the desired length with its ends stripped, so as to be bare wire, is obtained. Then, should magnet 6 be ceramic, it is copper coated. The copper coating can be applied to the ceramic magnet by a copper plating process, after preparation of the magnet for plating. The coating enables the wire to be conductively connected to magnet 6 and also to be electrically conductive when in contact with post 1. Then each stripped bare end of the wire is inserted into hole 8 until flush with inside surface of U-shaped magnet 6; then soldered to the coating so that electrical conduction exists between the conducting wire and magnet 6's coating. The said conducting wire is attached to magnet 6 similar to that shown in FIG. 6, in which wire 12 is attached to disc magnet 13 and soldered to its copper coating. In an analog computer, for example, as described in my U.S. Pat. No. 4,315,320, there is a requirement to make electrical connections between computing components, such as a summing amplifier, a potentiometer and a voltmeter. A step input voltage might be supplied by a battery via a switch to the said amplifier. Interconnections between the said components would be made with patch cords or hook-up wires. Using the apparatus suggested in this application, a patch cord, with a magnet 6 conductively-connected at each of its ends, would have one of its magnets 6 embrace the amplifier input terminal post 1 or a coil spring terminal 10, making contact by magnetic attraction, and the magnet at the other end of the cord embrace a terminal at the said switch. By making such interconnections between components, the step input voltage from the switch may be modified by the amplifier. The amplifiers's output could be applied to a voltmeter by another such patch cord in a similar manner. A steady-state voltage may be read on the voltmeter by the user. A fluctuating voltage, if any, may be observed on an oscilloscope, using similar patch cords for making interconnections between said amplifier's output and the oscilloscope's input. Patch cords with said U-shaped magnets enable the connections between components to be made more quickly than by using alligator clips or banana plugs at the ends or a patch cord. The insertion of a banana plug into a jack requires some force on the user's part, while applying a U-shaped magnet to a ferrous terminal would require no force or effort. Magnetic attraction would be sufficient to maintain electrical contact continuity between the magnet surface and a ferrous terminal, as described and shown in FIGS. 1B, 3B, 5 and 7. Another technique is shown in FIGS. 3A, 3B, 4A and 4B. In these alternate techniques, the concept, fabrication and use are similar to the description above. In the place of post 1, a coil spring terminal 10 is substituted, as shown in FIGS. 3A and 3B. In place of a U-shaped magnet, a disc-shaped magnet 13, as shown in FIGS. 4A and 4B, is used. FIGS. 3A and 3B show the top and elevation views of a spring type terminal. All views shown are enlarged at least by a factor of two(2). The spring's upper part (10) has spring coils of equal diameter, while its lower part 11 is tapered for insertion into a breadboard panel hole. Most spring terminals would have a wire or conductor connected to it underneath the panel, not shown. Interconnecting of wires between terminals is accomplished by placing wire ends between the coils of terminal spring 10. Example of a wire end 24 being inserted between coils is shown in FIG. 6. Additional interconnections of hook-up wires may be made by using the disc-shaped magnets of FIGS. 4A and 4B. Each magnet 13 has a hole 15 for insertion of a bare wire end of a hook-up wire. Narrower section 16, FIG. 4B fits into opening 10' of spring terminal 10. Cavity 14' on top of magnet 13 permits another such magnet to be stacked on top, if desired, as shown in FIG. 6. Top surface of magnet has a glossy plastic covering to avoid direct contact with any adjacent magnets, so that the magnets can be separated from each other more easily, particularly if the contacting surfaces are polished. FIG. 6 shows three cylindrical magnets 13 stacked one atop another, the bottom one resting upon terminal spring 10. Conducting wires 12 connect to each magnet 13 via hole 15 in magnet. Interior surface of hole 15 is copper-coated so that the bare wire may be soldered into the magnets via hole 15. Interior surface of cavity 14 and exterior surface 16 also are copper-coated to assure electrical conductivity between spring 10 and magnets 13. Wire 24 is inserted between coils of spring 10 for a more permanent connection. It is obvious that horseshoe-shaped magnet 6, FIG. 2A, could embrace coil spring terminal 10, FIG. 3A, as well as terminal post 1. Magnets are used at the same time to speed up connections.

For a simpler, less expensive approach to the application of magnets to a post, refer to FIGS. 7, 8A and 8B. Here a plain cylindrical ferrous metal post 22 is used with means for fastening it to a panel, such as screw threads 23. Magnetic ring, shown in FIGS. 8A and 8B may be a copper-coated cobalt, alnico or ceramic permanent magnet. Exterior surface 21 and bottom surface 21' may be a plastic sleeve with polished glossy exterior surfaces. The sleeve permits a space to occur between magnets as they are stacked one upon another on cylindrical post 22. As in FIG. 4B, a hole may exist on the side of each magnet for insertion and soldering of the bare end of a hook-up wire. In this arrangement, in order to remove a ring from the bottom of the stack the upper rings must be removed first. Hence, wires which one may wish to remove frequently should be located on top of the stack.

In FIG. 5, instead of equally spaced indentations, equally spaced nonferrous rings 18 are fastened to post 17 by cement or by other fastening means. Upper surface 7 of each ring is coated with both copper and ferrous paint for both good conduction and good magnetic adherence to post 17. Threads 19 are shown to enable post 17 to be fastened to a panel. However, other methods of fastening the post to a panel may be used.

There may be occasions when it would be desirable to hook up several electrically isolated posts at the same time. The technique is illustrated in FIGS. 9A, 9B, an assembly of post 1, magnets 6 and sleeve 25, with attached conductors 27. The posts shown are equally spaced. Horseshoe-shaped magnets are attracted to the ferrous metal posts. These are located inside sleeve 25, which keep the magnets in place when they are removed from posts 1. Sleeve 25 consists of 3 connected sub-sleeves, as shown in FIGS. 10A and 11A, which keep magnets 6 apart (not touching) and equally spaced-,—distance d. Sleeve 25 covers bottom, top and exterior sides 28 of the assembled magnets, as shown in FIGS. 10B and 11B. The sleeve by itself is shown in FIG. 11A, top view, and in FIG. 11B, side view. Sleeve 25 also assures that magnets 6 are not in contact when removed from posts 1.

There also may be occasions when it would be desirable to apply a magnet to a banana plug. This may be accomplished by the technique shown in assembly drawing, FIG. 12. Banana plug 30 has ferrous ring 31 encircling lower part of plastic sleeve 32 of banana plug. Insulated wire 36 protrudes through hole in sleeve 32. Magnet 6, FIG. 2A, makes contact with top of ferrous ring 31, and is adhered to it by magnetic attraction. Insulated wire 27 protrudes through hole in magnet 6.

FIGS. 13A and 13B show the side and top views of a split springy ferrous ring or band. Numeral 35 points to an elevated edge, while numeral 34 points to the split in the ring to enable ring to be spread apart a little to allow protrusions 33 on inside of ring to project into holes 33' of plastic sleeve 32, FIG. 14A, so ring 31 can make conductive contact with metal base portion of banana plug 30.

FIGS. 14A and 14B show the side and sectional views, respectively, of plastic sleeve, with internal thread not shown which screws onto threaded base portion of plug 30. FIG. 14B is a section taken along lines 14B—14B of FIG. 14A. A sectional view is desirable to show the existence of four identical, equally spaced holes 33' spaced around the perimeter of sleeve 32. No effort is being made to redesign a banana plug, except for providing holes 33' in sleeve 32.

FIG. 13C is a partial side view of Collar 31, showing Set Screw 36 holding Collar halves together.

The drawings are not to scale.

What is claimed is:

1. A hook-up apparatus for electrical experimentation purposes, comprising a ferrous metal terminal post adapted to receive hook-up wires, with horseshoe-shaped magnets conductively attached to the ends of said wires, whereby said magnets embrace and adhere to said terminal post by magnetic attraction, said apparatus thereby requiring no other mechanical means for said hook-up wires to maintain electrical contact with said post.

2. An apparatus according to claim 1, and wherein said post has equally vertically spaced circumferential reduced sections, each of said sections having a bottom surface, for receiving said horseshoe-shaped magnets, to enable said magnets to embrace said post, said magnets being thereby equally spaced, and each said magnet resting on said bottom surfaces of each of said reduced sections.

3. An apparatus according to claim 1, and wherein each of said bottom surface of said reduced sections is electrically conductive-coated for making better electrical connections with said terminal post.

4. An apparatus according to claim 1, and wherein said post has equally spaced circumferential rings of non-ferrous, non-magnetically attractable material, said horseshoe-shaped magnets being placed between said rings and adhering to said ferrous metal terminal post by magnetic attraction.

5. An apparatus according to claim 1, and wherein said ferrous metal terminal post is a coil spring terminal.

6. A quick electrical hook-up apparatus for electrical experimental purposes, comprising ferrous metal terminal posts and one or more hook-up wires, a magnet conductively attached to the outer end of each of said hook-up wires, said magnet being coated with conductive material and being shaped to encircle and adhere to one of said terminal posts by magnetic attraction, thereby requiring no other mechanical means for one of said hook-up wires to maintain electrical contact with one of said posts.

* * * * *